United States Patent [19]

Poe et al.

[11] 4,030,542

[45] June 21, 1977

[54] DRILL STRING MAKE-UP AND BREAK-OUT MECHANISM

[75] Inventors: Curtis Eugene Poe, Reynoldsville; Ronald Murray Cheers, Bridgeport, both of W. Va.

[73] Assignee: Ingersoll-Rand Company, Woodcliff Lake, N.J.

[22] Filed: Sept. 22, 1976

[21] Appl. No.: 725,679

Related U.S. Application Data

[63] Continuation-in-part of Ser. No. 618,792, Oct. 2, 1975, abandoned.

[52] U.S. Cl. ..... 166/77.5; 24/249 DP; 81/57.35; 173/164; 175/320

[51] Int. Cl.[2] ..... E21B 33/03; B25B 13/50

[58] Field of Search ..... 166/75, 77.5, 85, 242; 173/43, 164; 175/320; 64/1 S; 138/106, 107, 178; 269/321 N, 321 S; 81/57.35; 24/249 DP

[56] References Cited

UNITED STATES PATENTS

| | | | |
|---|---|---|---|
| 3,239,016 | 3/1966 | Alexander | 166/77.5 |
| 3,302,735 | 2/1967 | Klein et al. | 173/43 |
| 3,463,247 | 8/1969 | Klein | 166/77.5 |
| 3,768,579 | 10/1973 | Klein | 173/164 |

*Primary Examiner*—James A. Leppink
*Attorney, Agent, or Firm*—Frank S. Troidl

[57] ABSTRACT

The drill pipe has a longitudinal section of smaller diameter and a pair of circumferentially separated grooves provided in an annular shoulder adjacent the smaller diameter portion of the pipe. Pipe-holding members to which a pawl is connected are circumferentially spaced adjacent the drill pipe. The pipe-holding members and pawls are simultaneously actuated so that the holding members fit around the smaller diameter portion of the pipe to support the pipe, and the pawls fit into the grooves in the pipe to permit either the breaking out of the pipe string or the making up of the pipe string, depending on which pawl is fitted into the groove.

13 Claims, 10 Drawing Figures

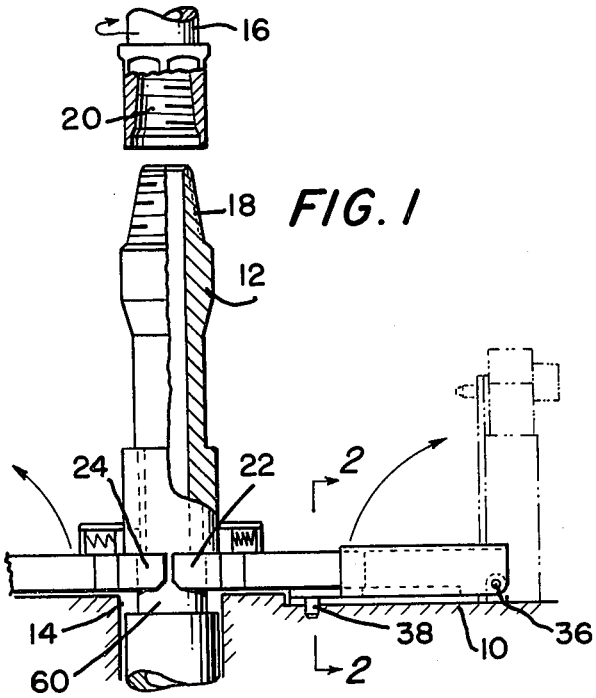
FIG. 1
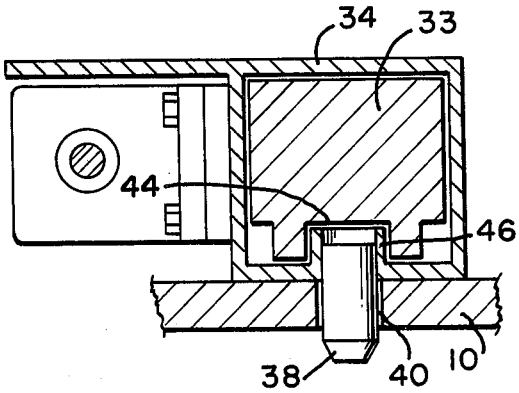
FIG. 2
FIG. 3
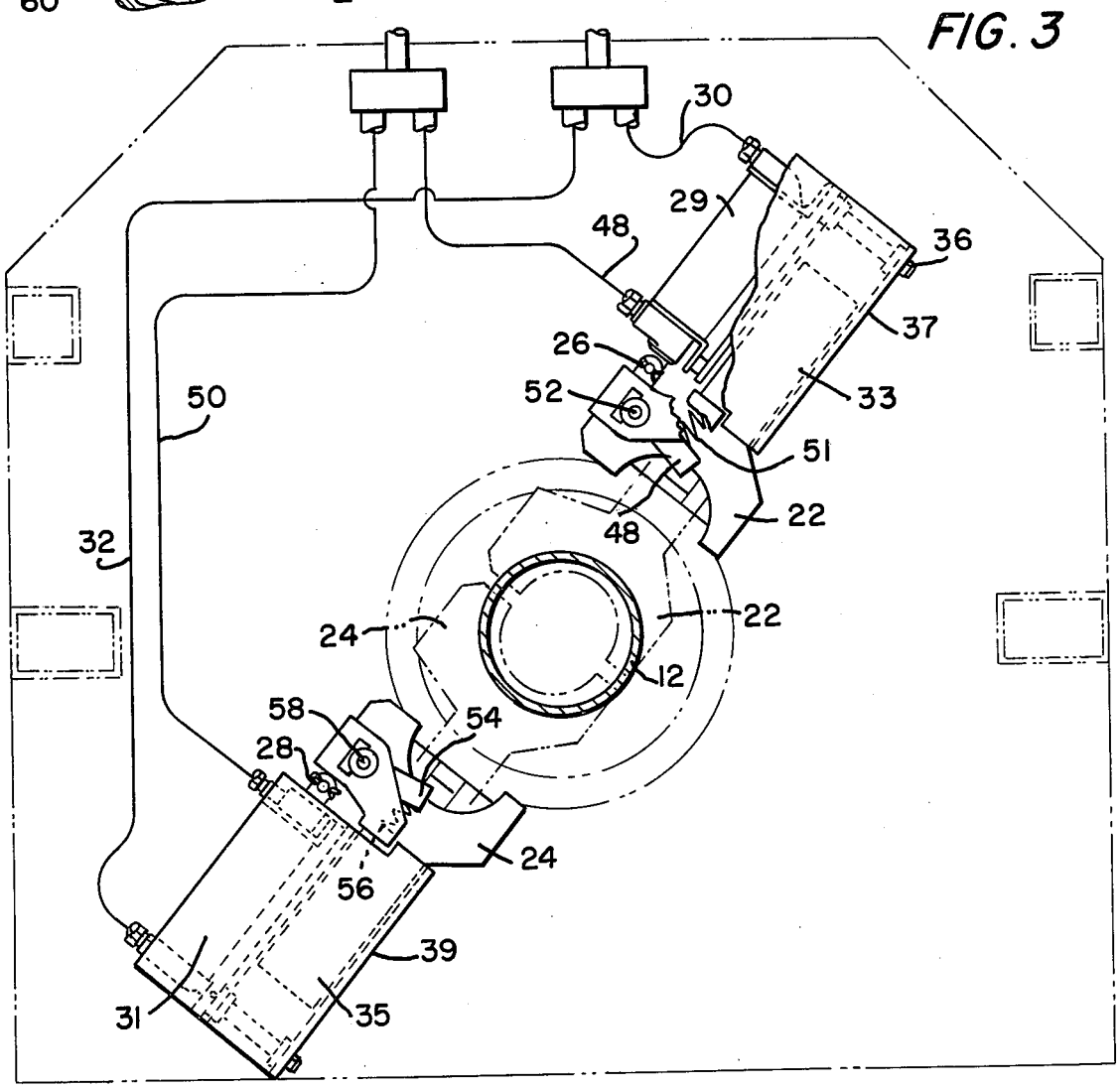

DRILL STRING MAKE-UP AND BREAK-OUT MECHANISM

This application is a continuation-in-part of our copending application Ser. No. 618,792 filed Oct. 2, 1975 entitled "DRILL STRING MAKE-UP AND BREAK-OUT MECHANISM" now abandoned.

This invention relates to drilling operations using a top head drive. More particularly, this invention is a new and novel drill string make-up and break-out mechanism and a new and novel drill pipe.

Briefly described, this new drill string make-up and break-out mechanism includes actuatable stop members adapted to contact grooves formed in the drill pipe. The grooves in the pipe are constructed and the stop members are constructed so that one stop member prevents rotation of the pipe in one direction, and the other stop member prevents rotation of the pipe in the other direction. A pair of actuatable pipe-holding members circumferentially spaced adjacent the drill pipe are actuated into contact with the pipe and are adapted to vertically support the pipe. Means are provided for actuating the stop members and the pipe-holding members into and out of contact with the pipe.

Briefly described, the new pipe structure of this invention is a pipe having a longitudinal section of smaller diameter thus providing an annular shoulder. A pair of circumferentially separated grooves are formed in the larger diameter portion of the pipe. The smaller diameter portion is adapted to receive the pipe-holding members so that the pipe may be supported and the grooves are adapted to receive stop members so that the pipe can be held against rotation.

The invention, as well as its many advantages, may be further understood by reference to the following detailed description and drawings in which:

FIG. 1 is an elevational view, partly in section, illustrating the make up of a drill string using our new pipe and new make-up and break-out mechanism;

FIG. 2 is a view taken along lines 2—2 of FIG. 1;

FIG. 3 is a top plan view, on an enlarged scale, showing in more detail our new drill string make-up and break-out mechanism; with the retracted position of the holding member shown in full lines and the extended position into contact with the drill pipe shown in broken lines;

Figure 8:
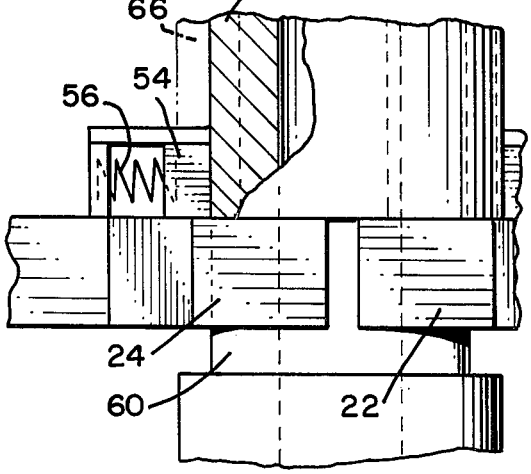
Figure 9:
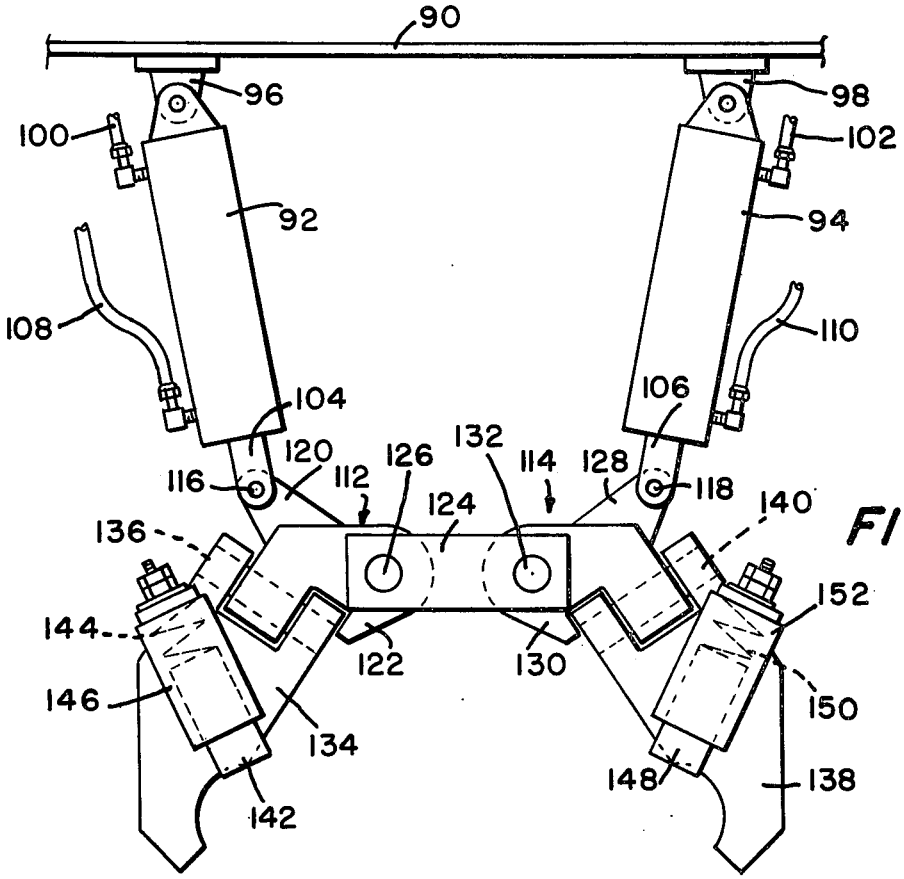
Figure 10:
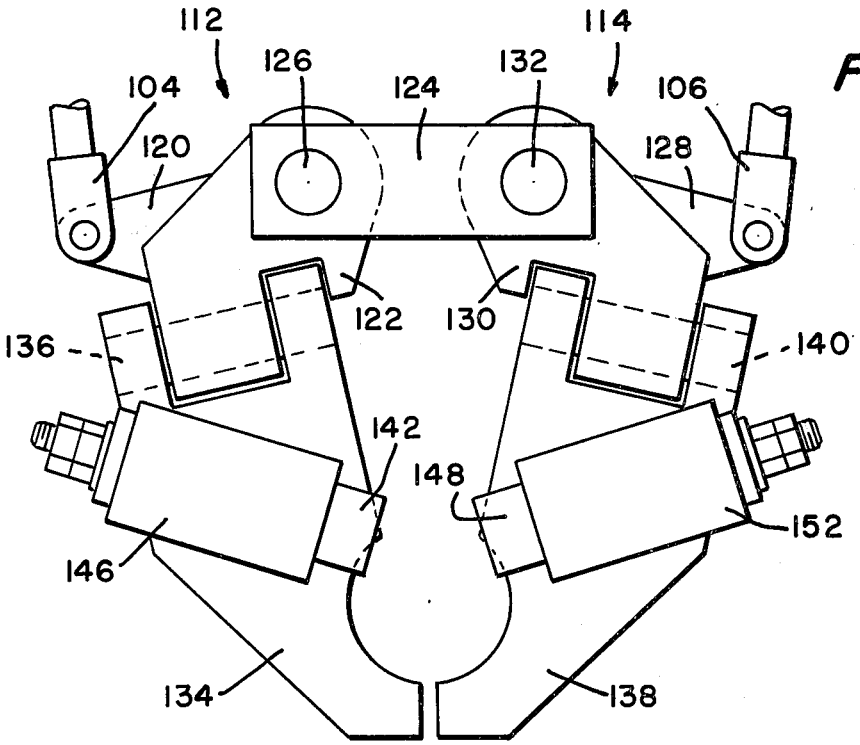

FIG. 8 is an elevational view, partly in section, illustrating the relationship of the pipe-holding member and stop members when they are used to support the drill pipe and hold the drill pipe against rotation for either make-up of the drill string or break-out of the drill string FIG. 9 is a top plan view showing another preferred embodiment of our invention with the holding members in retracted position; and FIG. 10 is a top plan view showing the embodiment of FIG. 9 with the holding members in pipe-engaging position.

Like parts in the various figures are referred to by like numbers.

Referring to the drawings, and more particularly to FIG. 1, a drill platform 10 is shown. The platform is located above a hole (not shown) being drilled. A first pipe 12 is supported in the platform hole 14 with a second pipe 16 supported by a top head drive (not shown); and pipe 16 is in a position to be lowered over the threads 18 of pipe 12 and turned in the direction of the arrow by the top head drive to make up the pipe string. The top head drive turns the pipe 16 in the direction of the arrow so that the female threads 20 on pipe 16 are screwed onto the male threads 18 on pipe 12.

In order to make up the pipe 16 on pipe 12, the pipe 12 must be supported and prevented from falling into the drill hole and also must be kept from rotating in any direction while the pipe 16 is turned by the top head drive.

The mechanism for supporting and holding the pipe 12 against rotation is shown in more detail in FIG. 3. As shown in FIG. 3, a pair of circumferentially spaced hydraulically actuated pipe-holding members 22 and 24 are shown adjacent the pipe 12. Pipe-holding members 22 and 24 are connected to shafts 26 and 28, respectively, with the shafts 26 and 28 being simultaneously actuated by a hydraulic actuating system, including hydraulic cylinders 29 and 31. Hydraulic fluid through lines 30 and 32 actuate the shafts 26, and 28, respectively, to move the pipe support members 22 and 24, respectively, into contact with the pipe 12, the contact positions of the holding members 22 and 24 being showing by broken lines in FIG. 3.

The shafts 33 and 35 of the pipe-holding members 22 and 24, respectively, move longitudinally within guide boxes 37 and 39, respectively. As shown in FIG. 1, the entire mechanism is pivotable about a pivot 36. A pin 38 fits into a hole 40 in the platform 10 when guide box 37 is in position on the platform 10.

Shaft 33 (see FIG. 2) of the pipe-holding member 22 is provided with a groove 44 which slides along an upraised guide 46. Hence, the holding member is guided during its movements into and out of contact with the pipe. As shown in FIG. 3, the holding members 22 and 24 may be retracted by feeding hydraulic fluid through lines 48 and 50 to move the shafts 26 and 28, respectively, so that the holding members 22 and 24 to which the shafts 26 and 28 are respectively connected, will be retracted.

A stop member such as pawl 48 which is spring biased by spring 51 is pivotally mounted by pivot pin 52 to the top of the holding member 22. Similarly, a pawl 54 which is spring biased by spring 56 is pivotally connected by pivot 58 to the holding member 24. Thus, the pawls are moved into and out of contact with the pipe 12 at the same time that the holding members 22 and 24 are moved into and out of contact with the pipe.

Figure 4:
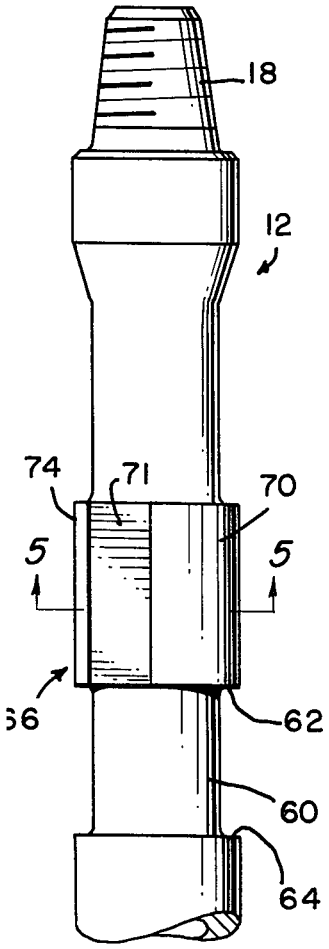
FIG. 4 is an elevational view of the top part of our new drill pipe.
Figure 5:
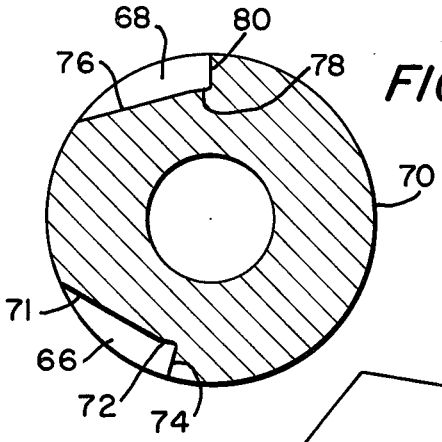
FIG. 5 is a view taken along lines 5—5 of FIG. 4

Referring specifically to FIG. 4 and FIG. 5, the pipe 12 includes a section 60 of smaller diameter thus providing a first annular shoulder 62 and a second annular shoulder 64. A first groove 66 and a second groove 68 are formed in the larger diameter portion 70 of the pipe 12. The grooves 66 and 68 may extend along the entire length of larger diameter portion 70 and into the shoulder 62. The groove 66 is formed by a vertical wall 71 extending from the edge of the pipe along a first chord and then along a second chord 72, which is slightly inwardly toward the center of the pipe, and then along the radially extending portion 74, with portion 74 being perpendicular to chord 72. Similarly, groove 68 is formed by a wall consisting of a first portion 76, extending from the edge of the pipe, and then a second portion formed from a different chord and then the radially extending portion 80 perpendicular to portin 78.

As it is shown clearly in FIG. 5, grooves 66 and 68 are separated in one direction (counter-clockwise looking at FIG. 5) by less than a 90° arc; whereas, the grooves 66 and 68 are separated in the other direction (clockwise looking at FIG. 5) by more than a 180° arc.

Figure 6:
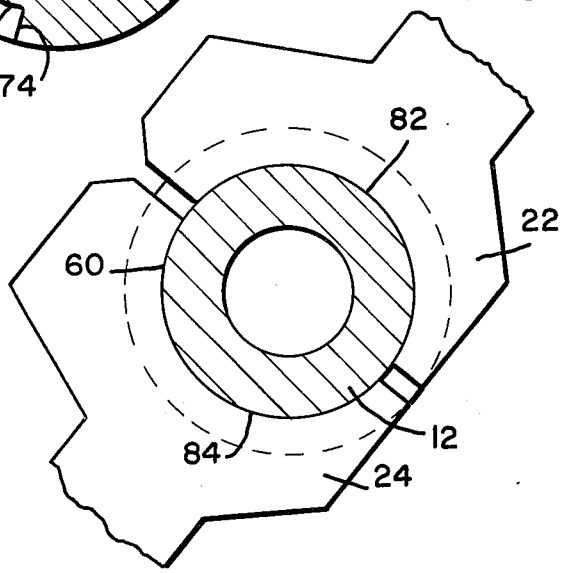
FIG. 6 is a fragmentary view, partly in section, illustrating the manner in which the holding members engage the smaller diameter portion of the pipe.

Referring to FIg. 6, each of the pipe-holding members 22 and 24 are provided with semicircular walls 82 and 84 respectively. The diameter of the walls 82 and 84 are substantially the same as the diameter of the smaller diameter portion 60 of the pipe 12 so that the semicircular walls of the pipe-holding members 22 and 24 will encompass the smaller diameter portion 60 of the pipe, and the top surfaces of the holding members will support the pipe.

Figure 7:
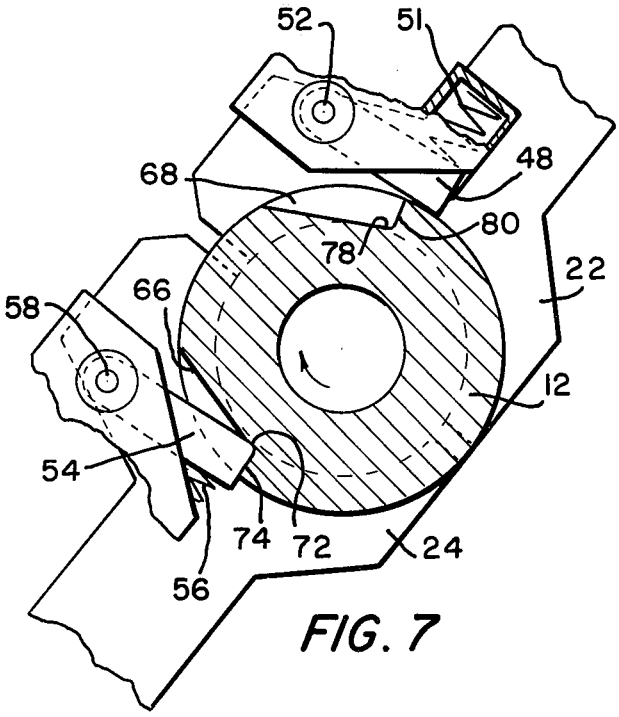
FIG. 7 is a fragmentary view, partly in section, illustrating the manner in which the stop members engage the grooves in the pipe.

As can be seen more clearly in FIG. 7, the outer end of the pawls, such as pawl 54, are provided with perpendicular edges with one edge conforming to the shape of the wall 72 of slot 66; and the other edge conforming to the shape of the radial wall 74. Similarly, pawl 48 has perpendicular edge walls which conform with the walls 78 and 80 of groove 68.

In the embodiment shown in FIGS. 9 and 10, a hydraulic cylinder support 90 is shown to which hydraulic cylinders 92 and 94 are pivotally mounted by means of a pivotal connection to cylinder mounts 96 and 98, respectively.

The support 90 and the cylinders 92 and 94 as well as the other equipment shown in FIG. 9 and FIG. 10, are of course mounted on or adjacent to a platform such as the platform 10 shown in FIG. 1.

Fluid fed through lines 100 and 102 to the fluid cylinders 92 and 94, respectively, extend the cylinder shafts 104 and 106, respectively. Fluid fed through hydraulic line 108 and 110 to cylinders 92 and 94, respectively, retract cylinder shafts 104 and 106, respectively.

Hydraulic cylinder shaft 104 and hydraulic cylinder shaft 106 are pivotally connected to pivoting links 112 and 114, respectively, by means of pivot pins 116 and 118, respectively. Pivot link 112 includes a pair of arms 120 and 122 which are pivotally connected to pivot link support 124 by pivot pin 126. Pivot link 114 consists of a pair of arms 128 and 130 which are pivotally connected to the pivot link support 124 by pivot pin 132.

The holding member includes a fork member pivotally connected to arm 122 by pivot pin 136. Fork member 138 is pivotally connected to arm 130 by pivot pin 140. A pawl 142 spring biased by spring 144 is mounted within a pawl guide 146 which is connected to the fork member 134. A pawl 148 which is spring biased by spring 150 is guided by pawl guide 152 which is connected to the fork 138.

FIG. 9 shows the positions of the parts of the second preferred embodiment when the forks 134 and 138 are in the retracted position pivoted away from the pipe to be held; and FIG. 10 shows the elements of the second embodiment in the pipe-holding position. The pipe, not shown in FIG. 9 and FIG. 10, is the same pipe described in the remaining figures.

In operation, pipe 12 is drilled down until the smaller diameter portion 60 is centered in the radii of the holding members 22 and 24, or if the second preferred embodiment of FIG. 9 and FIG. 10 is used, holding members 134 and 138. The cylinders are then activated by a hydraulic supply (or air supply if desired) to move the holding members into the smaller diameter portion 60 of the pipe 12. The pipe 12 is then supported by the holding members. Pipe 16 is then threaded onto pipe 12. Pipe 12 will rotate in a direction of the arrows shown in FIG. 7 until the pawl 54 fits into groove 66, or if the second preferred embodiment is used, until the pawl 142 fits into groove 66. Thereafter, further rotation of the pipe 12 is prevented and the pipe 16 is threaded securely onto the pipe 12.

When the pipe 16 has been made and connected to the pipe 12, the pipe may be pulled up slightly to relieve pressure from the holding members, and the holding members retracted. Thereafter, the drilling operation is continued. Should the pipe be pulled out before the holding members are retracted, the whole assembly will pivot about the pivot 36 to prevent breakage of the parts; or the holding members 134 and 138 will pivot about pivots 136 and 140, respectively, if the embodiment of FIG. 9 and FIG. 10 is used.

When it is desired to break out the pipe, the opposite procedure is used; that is, the pipe 16 is rotated in the opposite direction from the direction of the arrow shown in FIG. 1. The pipe 12 will also rotate in the opposite direction to that shown in FIG. 7 until the slot 68 is engaged by the pawl 48 or if the second preferred embodiment is used, engaged by pawl 148. Thereafter, further rotation of the pipe 12 is prevented and the pipe 16 is unscrewed from the pipe 12.

We claim:

1. A drill string make-up and break-out mechanism for use on a drill platform comprising; a pair of pipe-holding members mounted on the drill platform and circumferentially spaced adjacent the drill pipe, each pipe-holding member having a stop member connected thereto adapted to contact grooves formed in the drill pipe, the grooves in the drill pipe being constructed and the stop members being constructed so that one stop member prevents rotation of said pipe in one direction; and the other stop member prevents rotation of said pipe in the other direction; and means for fluidly simultaneously actuating said pipe-holding members, said pipe-holding members being adapted to vertically support the pipe when actuated into contact with the pipe.

2. The mechanism of claim 1 wherein the stop members are spring biased pawls.

3. The mechanism of claim 1 wherein the ends of the pipe-holding members have a wall of substantially semicircular shape with a diameter substantially the same as a smaller diameter portion of pipe so that the wall encompasses the smaller diameter portion of the pipe, and the top surfaces of the holding members support the pipe.

4. The mechanism of claim 1 wherein: the means for fluidly simultaneously actuating said pipe-holding members ncludes a hydraulic cylinder for each pipe-holding member, a shaft extending from each hydraulic cylinder, and means interconnecting the shaft and the holding member.

5. The mechanism of claim 1 wherein the means for fluidly simultaneously actuating said pipe-holding members includes a hydraulic cylinder for each pipe-holding member, a shaft extending from each hydraulic cylinder, and pivotable means interconnecting the shaft and the holding member.

6. A drill string make-up and break-out system for use on a drill platform comprising: a plurality of pipes, each pipe having a section of a reduced diameter thereby providing an annular shoulder; and each pipe also having a pair of circumferentially separated grooves; a pair of circumferentially separated pipe-holding members mounted on the drill platform and adapted to engage the pipe at the reduced diameter portion and support the pipe by contact of the annular shoulder on the top surfaces of the pipe-holding members; and a stop member connected to each pipe-holding member, each stop member adapted to engage a slot in the pipe with one of said stop members preventing rotation of the pipe in one direction; and the other stop member preventing rotating of the pipe in the other direction.

7. The system in accordance with claim 6 wherein the stop members are spring biased pawls.

8. The system in accordance with claim 7 wherein the spring biased pawls are connected to the pipe-holding members adjacent the top of the pipe-holding members, means are provided for actuating the spring biased pawls and pipe-holding members simultaneously; and the circumferentially separated slots on the pipe are located longitudinally adjacent the smaller diameter portion of the pipe.

9. The system of claim 8 wherein the pawl and pipe-holding mechanism is pivotable vertically out of contact with the pipe.

10. The system of claim 9 wherein the pipe-holding member is provided with a substantially semicircular wall adapted to encompass the smaller diameter portion of the pipe so that the pipe-holding members fit about the smaller diameter portion of the pipe to support said pipe vertically and along with the pawls, prevent rotation of the pipe during make-up and break-out of the pipe string.

11. A new pipe structure for use in making up and breaking out drill strings comprising; a pipe having a longitudinal section of smaller diameter, thus providing an annular shoulder, and a pair of circumferentially separated grooves formed in the larger diameter portion of the pipe, each groove consisting of a vertical first wall extending along a first chord and than a second chord of the circular cross section of the pipe, and the wall then extending substantially radially with respect to the cross section of the pipe and perpendicular to said second chord, the smaller diameter section being adapted to receive pipe-holding members so that the pipe may be supported and the grooves being adapted to receive stop members so that the pipe can be held against rotation in either direction.

12. A pipe in accordance with claim 11 wherein: the grooves extend longitudinally to the annular shoulder.

13. A pipe in accordance with claim 11 wherein: the grooves are circumferentially separated in one direction by less than a 90° arc and circumferentially separated in the other direction by more than a 180° arc.

* * * * *